US007150114B2

(12) United States Patent
Park

(10) Patent No.: US 7,150,114 B2
(45) Date of Patent: Dec. 19, 2006

(54) SHOE SOLE FOR TRIPLE-TIME STEPPING

(75) Inventor: Moon-Hwan Park, Seoul (KR)

(73) Assignee: Healko Co., Ltd. (KR)

( * ) Notice: Subject to any disclaimer, the term of this patent is extended or adjusted under 35 U.S.C. 154(b) by 127 days.

(21) Appl. No.: 11/006,480

(22) Filed: Dec. 7, 2004

(65) Prior Publication Data

US 2006/0117603 A1 Jun. 8, 2006

(51) Int. Cl.
*A43B 13/14* (2006.01)
*A43B 3/12* (2006.01)

(52) U.S. Cl. ..... 36/103; 36/11.5; 36/25 R; 36/140

(58) Field of Classification Search ..... 36/103, 36/102, 110, 132, 11.5, 25 R, 140, 142
See application file for complete search history.

(56) References Cited

U.S. PATENT DOCUMENTS 4,262,433 A * 4/1981 Hagg et al. ..... 36/25 R
4,372,059 A * 2/1983 Ambrose ..... 36/32 R
5,507,106 A * 4/1996 Fox ..... 36/103
5,826,351 A * 10/1998 Tsuji ..... 36/25 R
5,974,699 A 11/1999 Park ..... 36/103
6,115,946 A * 9/2000 Morris et al. ..... 36/115
6,684,532 B1 * 2/2004 Greene et al. ..... 36/28
2002/0144428 A1 * 10/2002 Hay ..... 36/25 R

* cited by examiner

*Primary Examiner*—Ted Kavanaugh
(74) *Attorney, Agent, or Firm*—Perman & Green, LLP.

(57) ABSTRACT

The present invention relates to a shoe sole for triple-time stepping that includes: a front portion having a front end gently inclined upward, and a bottom portion in even contact with the ground; a rear portion having a second cutout inclined upward at an angle of about 15 to 17° from a rear end of the front portion, and a first cutout inclined upward at an angle of about 15 to 25° from a rear end of the second cutout; a first recess formed upward in a predetermined depth on a boundary portion between the front portion and the second cutout; and a second recess formed upward in a predetermined depth on a boundary portion between the second cutout and the first cutout. The improved shoe sole enables a tri-time stepping on walking to remarkably mitigate a fatigue with a massage effect produced from a proper stimulation of the flow of energy to prevent flat-foot walks and promote metabolism and blood circulation, and disperses the impact force caused by the weight to prevent diseases such as arthritis, back pain, muscle pain, or the like.

7 Claims, 13 Drawing Sheets

SHOE SOLE FOR TRIPLE-TIME STEPPING

BACKGROUND OF THE INVENTION

1. The Field of the Invention

This invention relates to a shoe sole for triple-time stepping. More particularly, this invention relates to a shoe sole for triple-time stepping that has the rear portion inclined in two steps at a predetermined angle to achieve a triple-time stepping in a natural and accurate manner.

2. Related Prior Art

As shoes are considered as a means for protecting feet from external impact force, a number of functional shoes of various shapes and structures have been suggested for the purpose of providing good comfort.

In general, shoes mitigate the transmission of the impact force produced from a pedestrian's weight to the vertebra. An ideal walking gait, so called "a triple-time stepping", is well known that a procedure of landing is followed in the order of a heel, a sole, and toes.

A conventional shoe has a heel attached to the rear portion of a shoe sole that is formed on a flat bottom surface. Such a conventional shoe has some drawbacks that a load caused by the pedestrian's weight is concentrated on the heel on walking to transmit the impact force to the vertebra, inducing pains on waist, shoulders, neck and the like, and causing deformation of toes. Also, since no triple-time stepping is achieved, the pedestrian is susceptible to fatigue while walking.

In view of the matter described above, a shoe has been proposed that the rear portion of a shoe sole has a height lower than that of the remainder portion, as shown in FIG. 1. With this construction, the shoe has a cutout 1 firstly touched on the ground on walking, thereby increasing a muscular strength and reforming a walking gait, without achieving a triple-time stepping.

To solve this problem with the above-constructed shoe, the applicant of the present invention has suggested a shoe for triple-time stepping as disclosed in Patent Application No. 239854 (under the title of "Healthful Shoe").

The shoe of the cited patent includes, as shown in FIG. 2, a bottom portion 2 of a shoe sole in contact with the ground; front and rear recesses 3 and 4 formed on either side of the bottom portion 2; and front and rear cutouts 5 and 6 inclined upwardly from the front and rear recesses 3 and 4 to the front and rear sides of the shoe sole, respectively.

This shoe construction is designed to achieve a triple-time stepping on walking that a procedure of landing is followed in the order of the rear cutout 6, the bottom portion 2, and the front cutout 5.

However, the shoe construction concentrates a load mostly on the heel of the shoe sole on walking, so it only achieves a dual-time stepping rather than a triple-time stepping and makes the standing posture considerably uncomfortable and unstable.

SUMMARY OF THE INVENTION

It is therefore an object of the present invention to overcome the foregoing and other problems encountered in connection with the prior art, and to provide a healthful shoe that has a rear portion of the shoe sole inclined in two steps to enable a natural triple-time stepping and decentralizes/mitigates the impact force during the movement of the pedestrian's weight to minimize the fatigue on walking.

It is another object of the present invention to provide a healthful shoe that can correct the walking gait and promote the blood circulation for health improvement.

To achieve the above objects of the present invention, there is provided a shoe sole for triple-time stepping that includes: a front portion having a front end gently inclined upward, and a bottom portion in even contact with the ground; a rear portion having a second cutout inclined upward at an angle of about 5 to 17° from a rear end of the front portion, and a first cutout inclined upward at an angle of about 5 to 25° from a rear end of the second cutout; a first recess formed upward in a predetermined depth on a boundary portion between the front portion and the second cutout; and a second recess formed upward in a predetermined depth on a boundary portion between the second cutout and the first cutout.

DETAILED DESCRIPTION OF THE INVENTION

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive. To clarify the present invention, parts not described in the specification are omitted.

Figure 1:
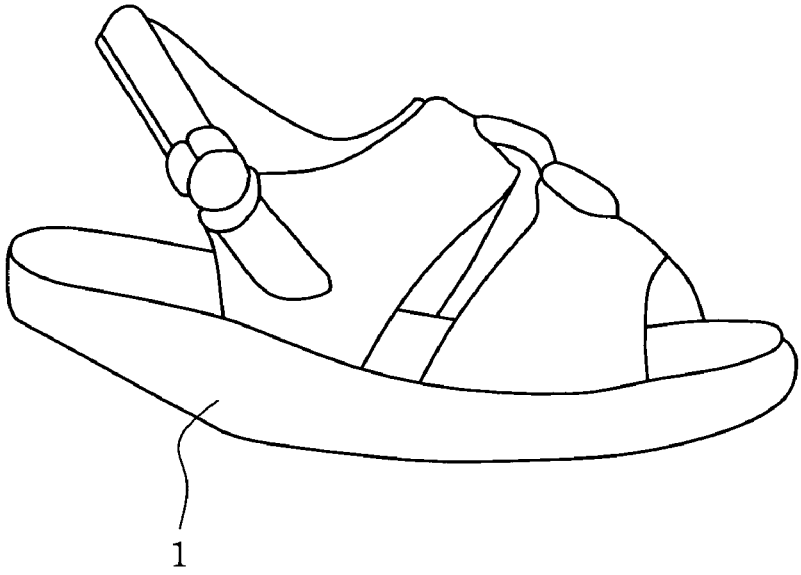
FIG. 1(PRIOR ART)
FIG. 1 is a perspective view of a shoe having a general shoe sole.
Figure 2:
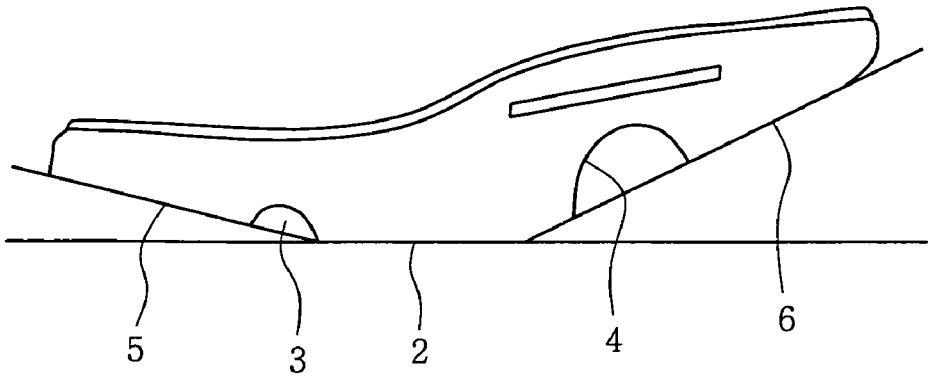
FIG. 2(PRIOR ART)
FIG. 2 is a side view of a conventional shoe sole according to the cited patent of the applicant.
Figure 3:
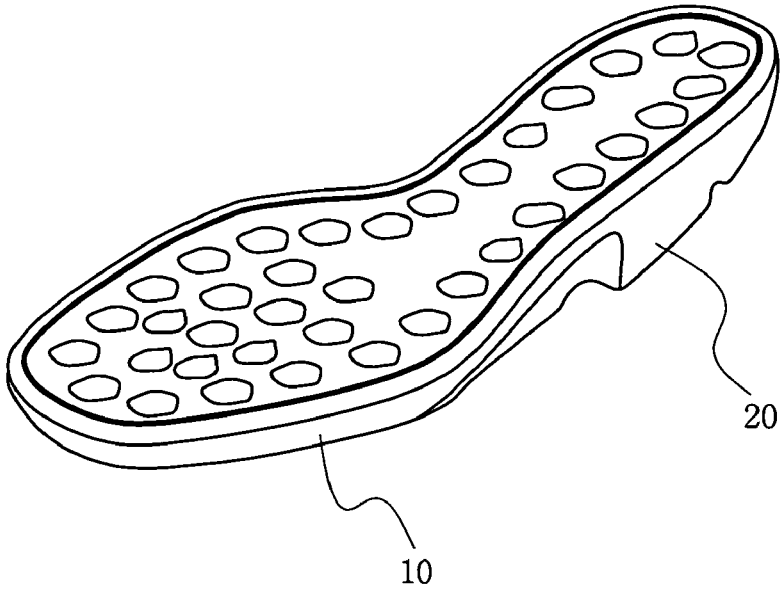
FIG. 3 is a perspective view of a shoe sole for triple-time stepping according to the present invention.

FIG. 3 is an exemplary perspective view of a healthful shoe employing a shoe sole of the present invention. The shoe sole of the present invention includes front and rear portions 10 and 20.

The shoe sole, which is the undermost part of the shoe in direct contact with the ground, is manufactured in various shapes and structures with different materials in consideration of walking comfort, ground landing force, durability, and other conditions.

According to the present invention, the shoe sole is divided into front and rear portions 10 and 20. The front portion 10 is gently inclined upward to a front end, which downwardly extends back to a bottom portion in even contact with the ground. The rear portion 20 is inclined upward to a rear end in two steps.

More specifically, the shoe sole of the present invention is substantially the same as the conventional shoe sole in that the front end of the front portion 10 is gently inclined upward and extends back to the bottom portion in even contact with the ground.

Figure 4:
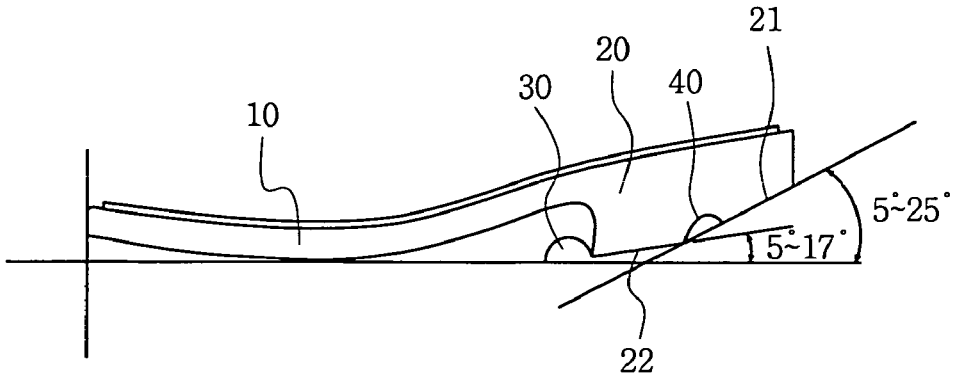
FIG. 4 is a side view of FIG. 3.
Figure 5:
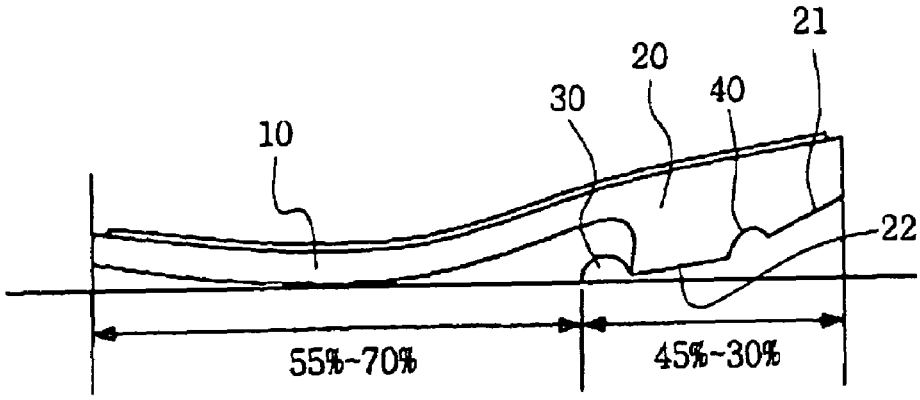
FIG. 5 is a side view showing the size ratio of front and rear portions of the shoe sole according to the present invention.

Characteristic to the present invention, as shown in FIG. 4, the rear portion 20 is inclined backward in two steps, with a second cutout 22 formed on the front of the front portion and inclined at an angle of about 5 to 17°, and a first cutout 21 formed on the rear of the front portion and inclined at an angle of about 5 to 25°. Particularly, the rear portion 20 is curved upward to form a first recess 30 on the boundary portion between the front and rear portions 10 and 20, and a second recess 40 on the boundary portion between the first and second cutouts 21 and 22.

In the rear portion 20, the first cutout 21 firstly touched on the ground on walking is inclined at an angle of about 5 to 25°, and the second cutout 22 formed in front of the first cutout 21 is inclined at an angle of about 5 to 17° more gently than the second cutout 21.

The size of the human foot is generally dependent upon the body stature, i.e., height and weight, but front and rear portions of the foot mostly have a constant proportion. Most preferably, the front and rear portions of the shoe sole have a proportion of 63% 37% with respect to the front end of the first recess 30.

Figure 6:
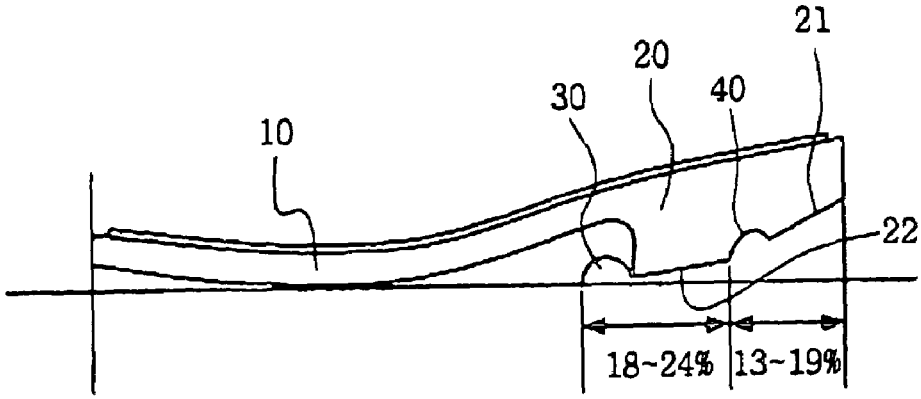
FIG. 6 is a side view showing the proportions of first and second cutouts in the rear portion according to the present invention.

In the rear portion 20 having a proportion of 37% in the shoe sole, the first cutout 21 has a proportion of 13 to 19% and the second cutout 22 has a proportion of 18 to 24% with respect to the front end of the second recess 40, as shown in FIG. 6.

Figure 7:
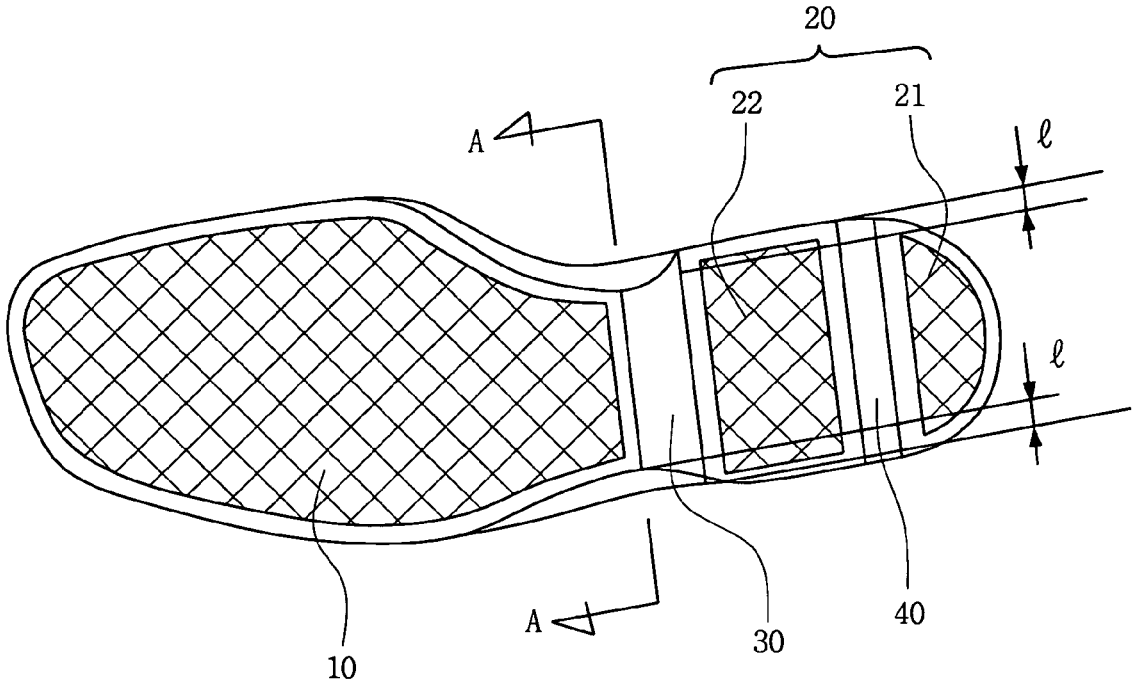
FIG. 7 is a bottom view showing that both sides between the front and rear portions of the shoe sole are recessed inward according to the present invention.
Figure 8:
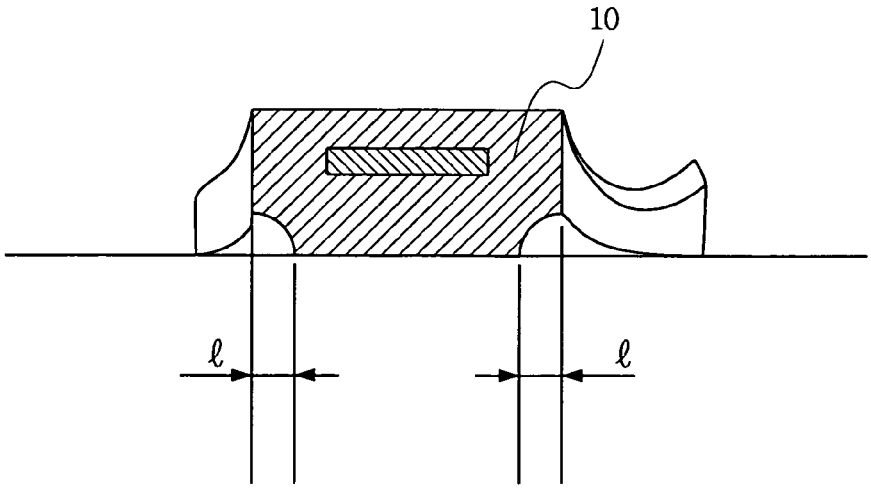
FIG. 8 is a cross-section taken along the line A—A of FIG. 7.

Regarding both ends of the first recess 30, i.e., both lateral sides of the shoe sole, as shown in FIGS. 7 and 8, the lateral gap 1 between the upper and lower ends is in the range of 3 to 5 mm so that the bottom side has a width smaller than that of the topside in the first recess 30.

Figure 9:
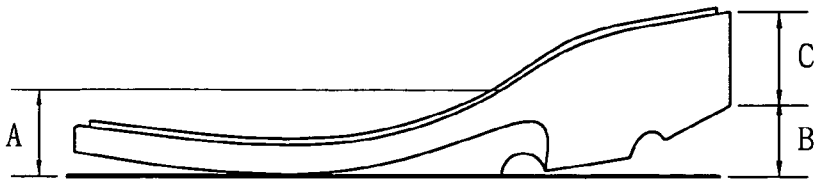
FIGS. 9, 10 and 11 are side views showing that the sole height is determined depending on the foot size according to the present invention.

In the present invention, the shoe sole has a height slightly different from portion to portion in consideration that the foot size is somewhat dependent upon the body stature as stated previously. Namely, as shown in FIG. 9, the vertical height on the front end of the first recess 30, i.e, the sole thickness A, the height B from the ground to the rear end of the first cutout 21, and the height C from the height B to the uppermost end of the rear end of the rear portion 20 are differently determined. For a shoe size of more than 275 mm, the vertical height A on the front end of the first recess 30 starting the rear portion 20 is about 31 mm, the height B from the ground to the rear end of the first cutout 21 of the rear portion 20 being about 27 mm, the height C from the lower end of the first cutout 21 to the uppermost end on the rear end of the rear portion 20 being about 32 mm.

Figure 10:
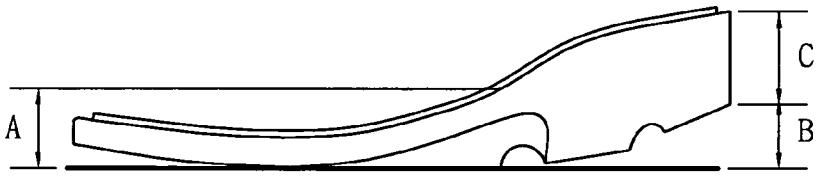

For a shoe size of 260 to 270 mm, as shown in FIG. 10, the vertical height A on the front end of the first recess 30 starting the rear portion 20 is about 30 mm, the height B from the ground to the rear end of the first cutout 21 of the rear portion 20 being about 26 mm, the height C from the lower end of the first cutout 21 to the uppermost end on the rear end of the rear portion 20 being about 32 mm.

Figure 11:
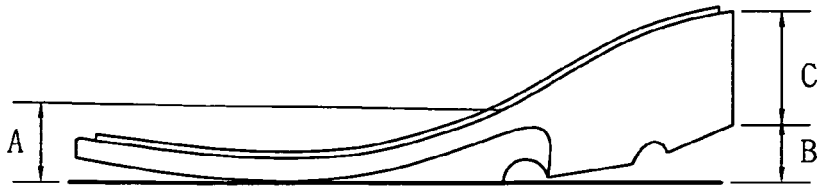
Figure 12:
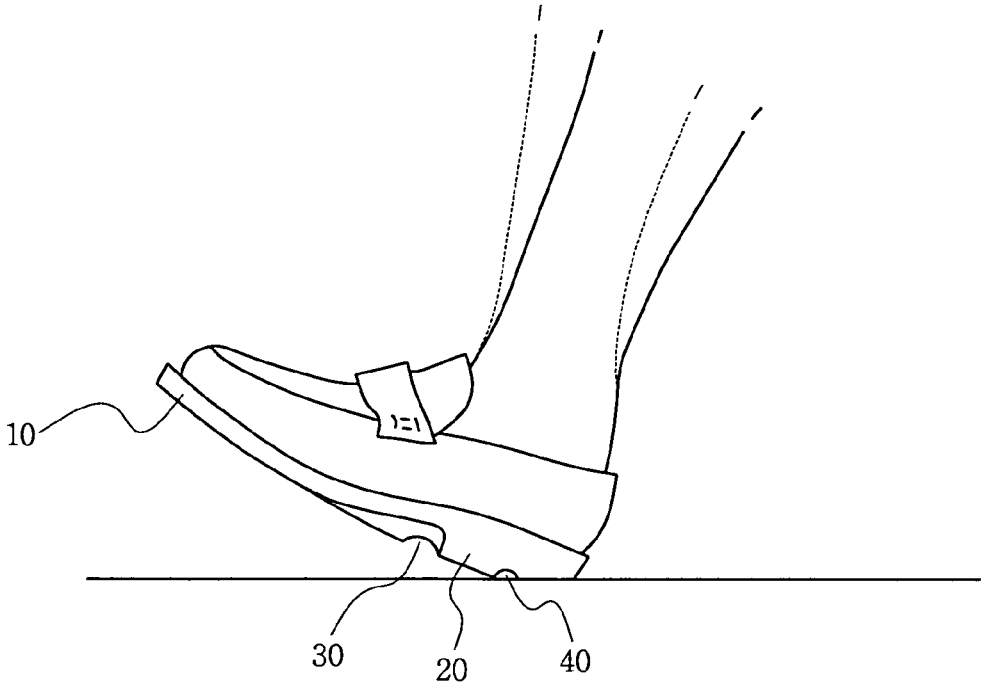
FIGS. 12, 13 and 14 show the use of shoes with the shoe sole of the present invention on walking.

For a shoe size of 245 to 255 mm, as shown in FIG. 11, the vertical height A on the front end of the first recess 30 starting the rear portion 20 is about 29 mm, the height B from the ground to the rear end of the first cutout 21 of the rear portion 20 being about 25 mm, the height C from the lower end of the first cutout 21 to the uppermost end on the rear end of the rear portion 20 being about 35 mm.

The shoe sole for triple-time stepping according to the present invention as constructed above enables a natural triple-time stepping on walking. The mechanism of the shoes with the shoe sole of the present invention can be described as follows.

On walking with the shoes employing the shoe sole as constructed above, the first cutout 21 of the rear portion 20 is firstly landed on the ground for the first step.

Figure 13:
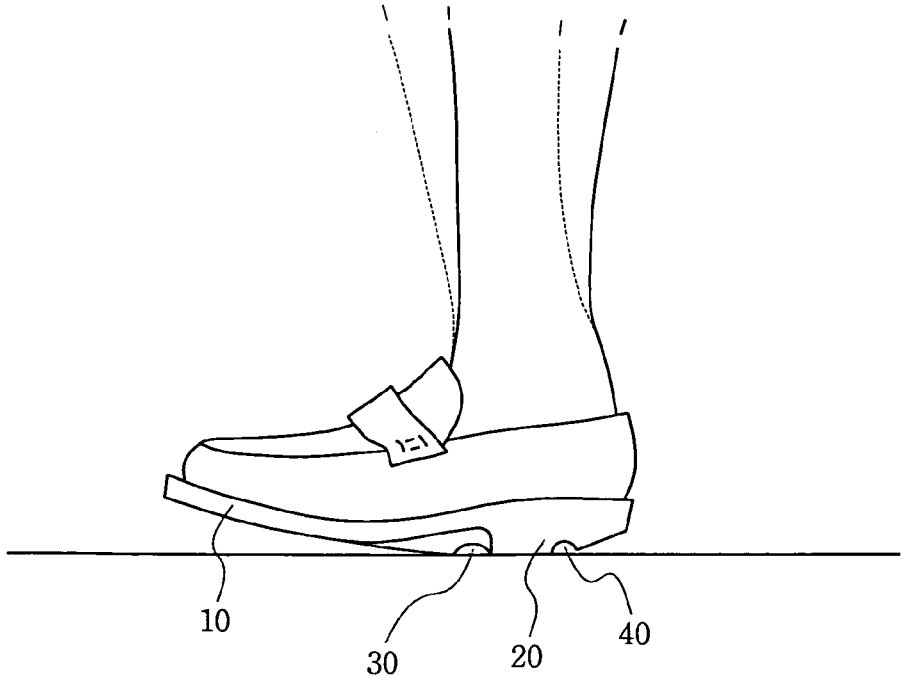

Thereafter, when the center of the body is moved for a forward step, the second cutout 22 is landed on the ground subsequent to the first cutout 21, as shown in FIG. 13.

Figure 14:
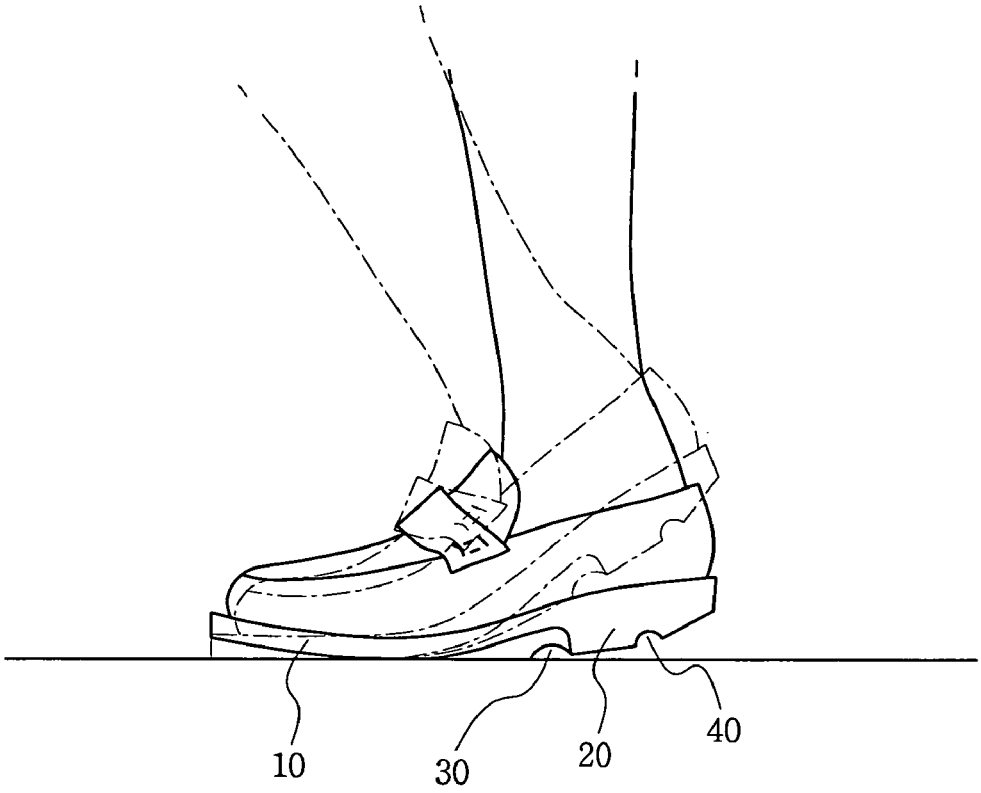

As the center of the body is shifted from the rear portion 20 to the front portion 10 while the second cutout 22 is on the ground, the bottom portion of the front portion 10 gets in contact with the ground, as shown in FIG. 14.

As such, the load caused by the weight mostly concentrated on the rear portion 20 is dispersed to the first cutout 21 of the rear portion 20 and the second cutout 22 in sequence, and the center of the body is more shifted forward to disperse the load to the front portion 10 to enable a triple-time stepping and relieve transmission of the impact force caused by the weight to the vertebra.

Particularly, the dispersion of the load to the first and second cutout 21 and 22 deforms the second recess 40 and the first recess 30 in sequence to mitigate the impact force and more reduce the fatigue on the feet on walking for a long time.

Figure 15:
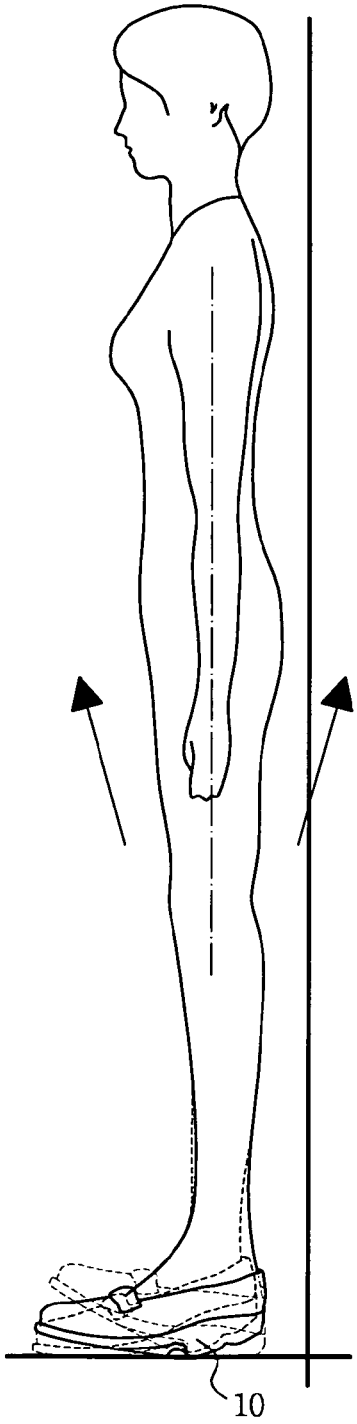
FIG. 15 is a side view showing a standing posture on healthful shoes of the present invention.

Further, when standing still on the shoes with the shoe sole of the present invention, one can maintain a good posture with stability whatever portion of the shoe sole is in contact with the ground, as shown in FIG. 15.

Figures 16, 17:
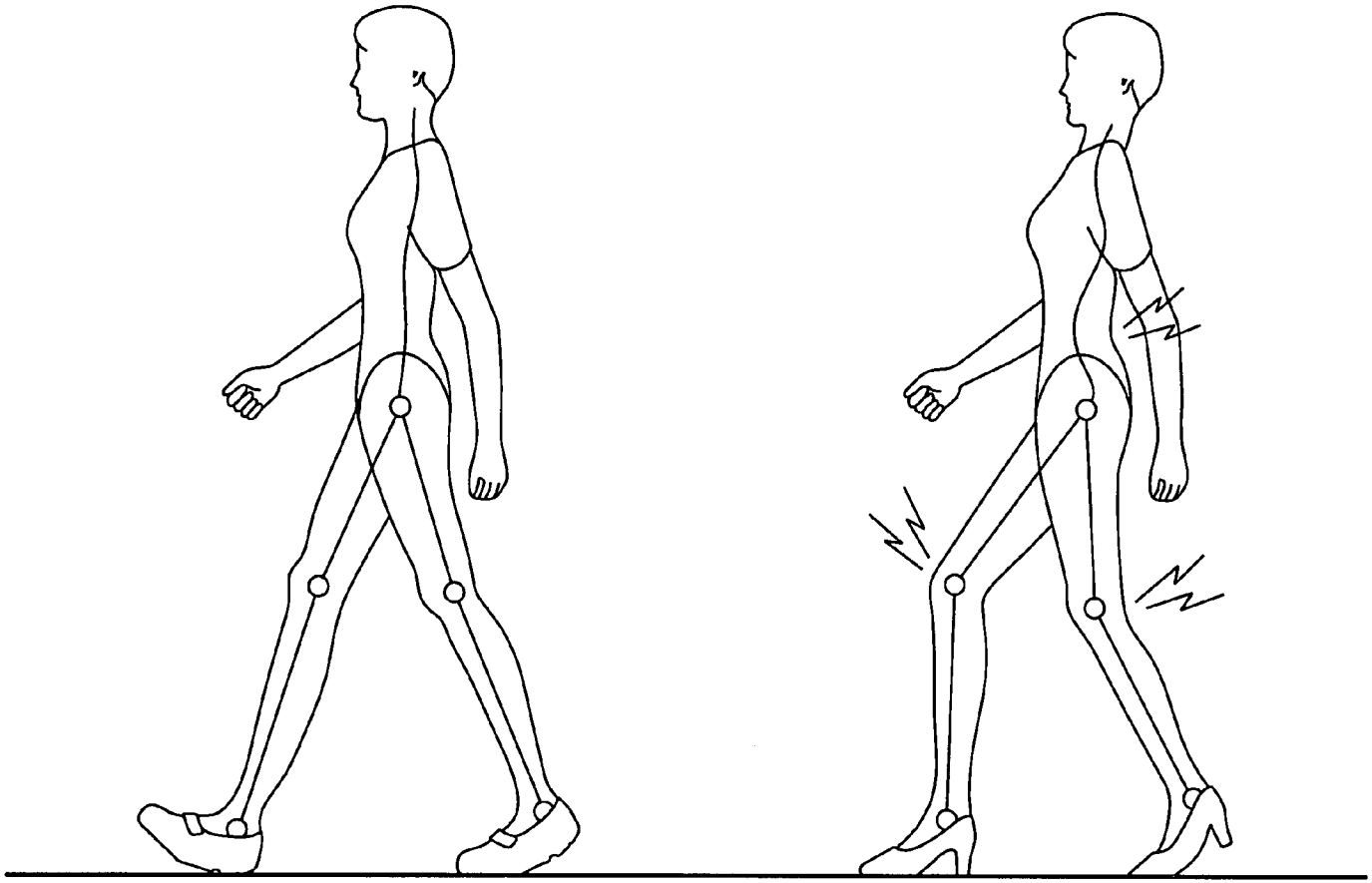
FIGS. 16 and 17 show a comparison of the impact force while waling on the healthful shoes of the present invention and the conventional shoes.

While having a natural triple-time stepping on the shoes with the shoe sole of the present invention, the load is appropriately distributed according to the state of the shoe sole in contact with the ground to maintain a stable walking with a good posture, as shown in FIG. 16. Hence, this prevents the problem with a walking on the conventional shoes as shown in FIG. 17 that the pedestrian cannot keep a good walking gait to concentrate the load on the joints and the vertebra.

The sole height is given differently depending on the size of the shoe, as shown in FIGS. 9, 10 and 11, so as to achieve a triple-time stepping adequate to the pedestrian's body stature.

Both lateral sides of the shoe sole having the first recess 30 is recessed downward from the upper end to the lower end as much as a predetermined gap, as shown in FIGS. 7 and 8, in such a manner that the bottom side of the shoe sole on the boundary portion between the front and rear portions 10 and 20 has a width smaller than that of the topside. This supports a part of the foot sole inclined inwardly to keep the pedestrian from having a flat-foot walks and stimulates the flow of energy with a massage effect to promote metabolism and blood circulation.

Figure 18:
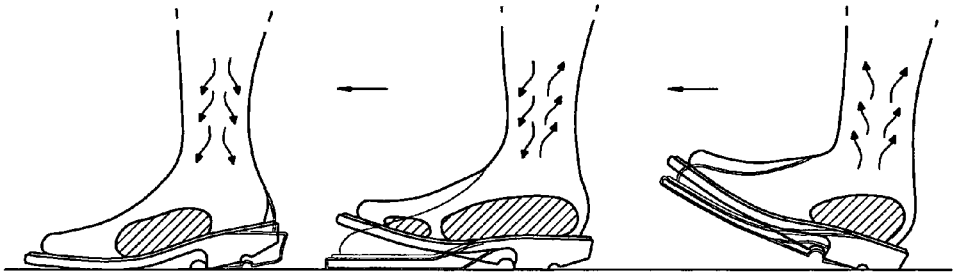
FIG. 18 shows a flow of blood depending on the landing state of the healthful shoes of the present invention.
Figure 19A:
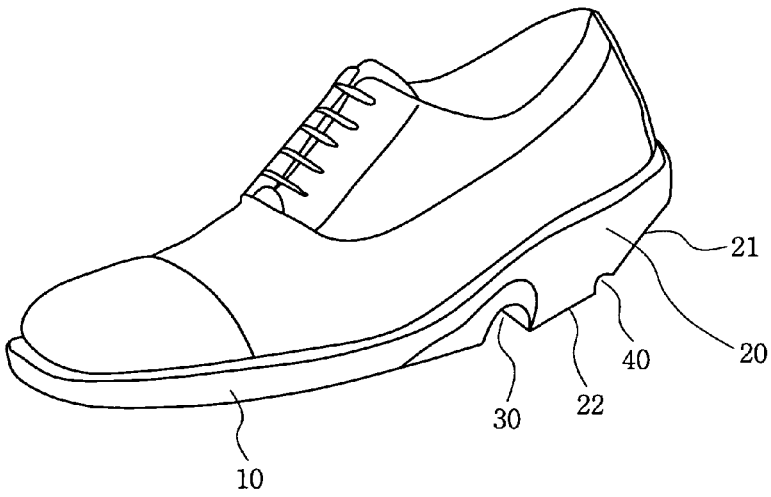
FIGS. 19A to 19G are perspective views showing various shoes employing the shoe sole of the present invention.
Figure 19B:
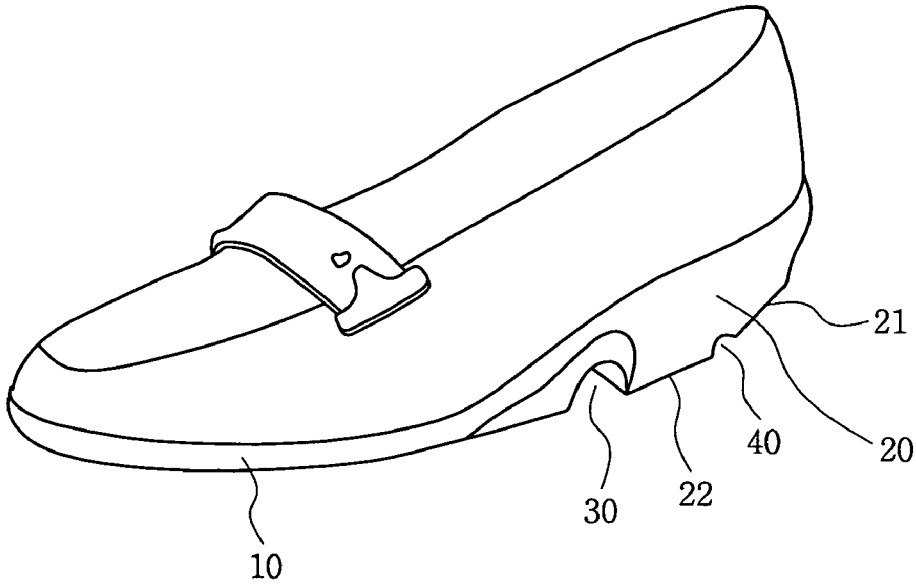
Figure 19C:
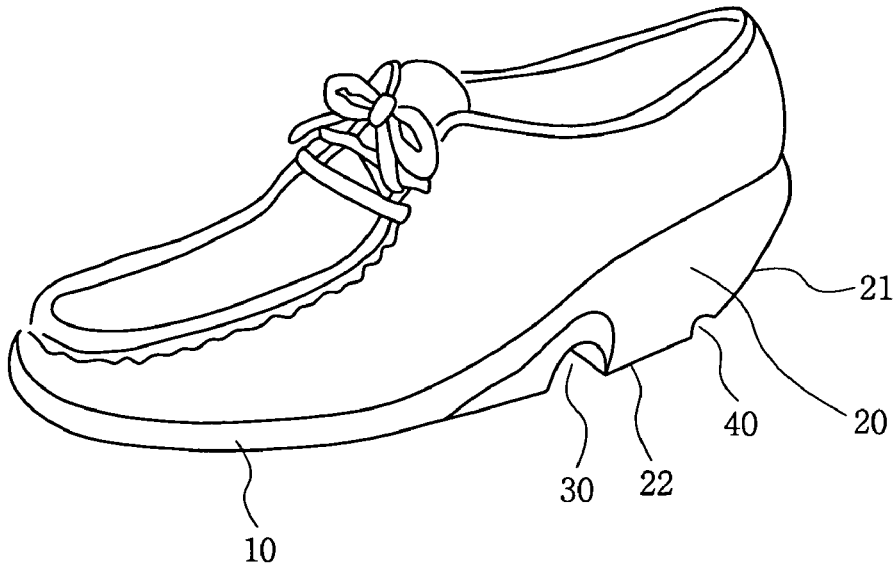
Figure 19D:
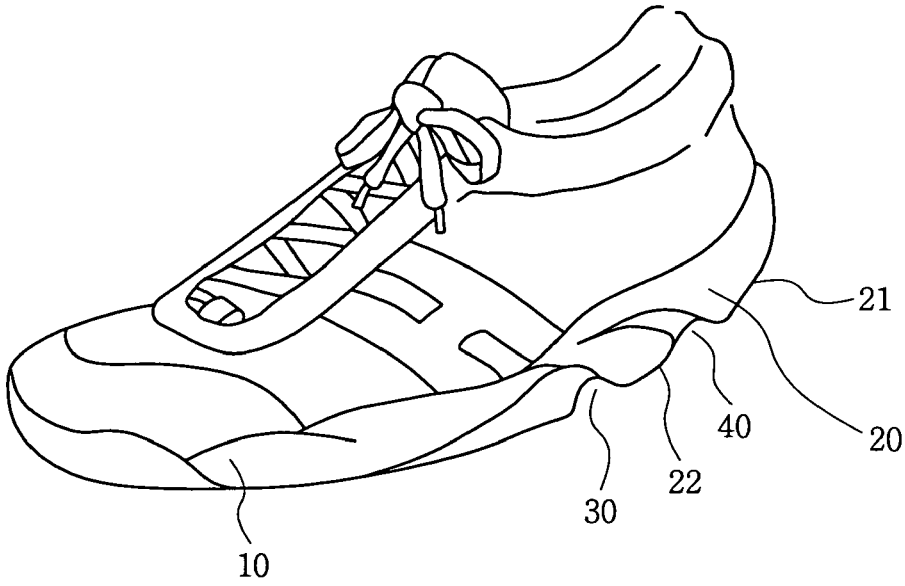
Figure 19E:
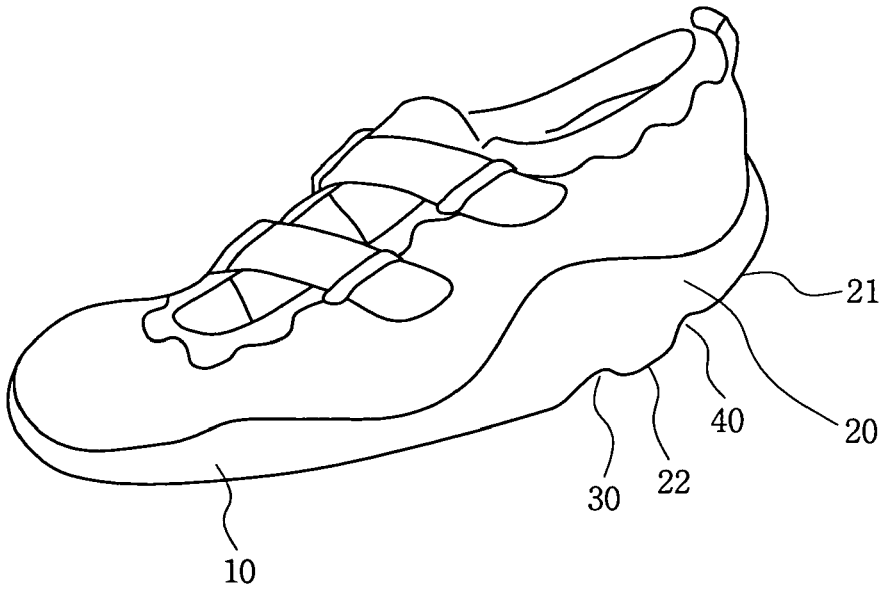
Figure 19F:
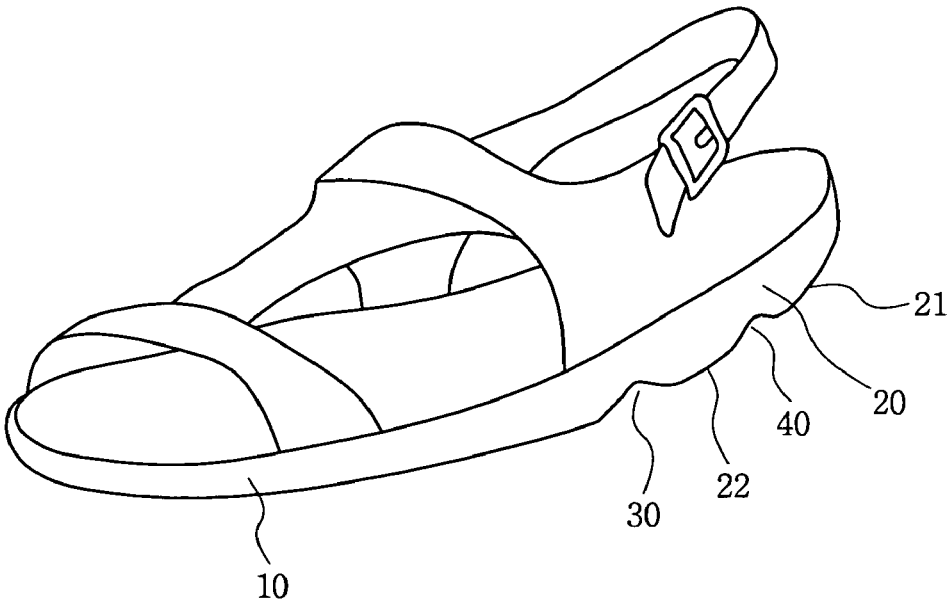
Figure 19G:
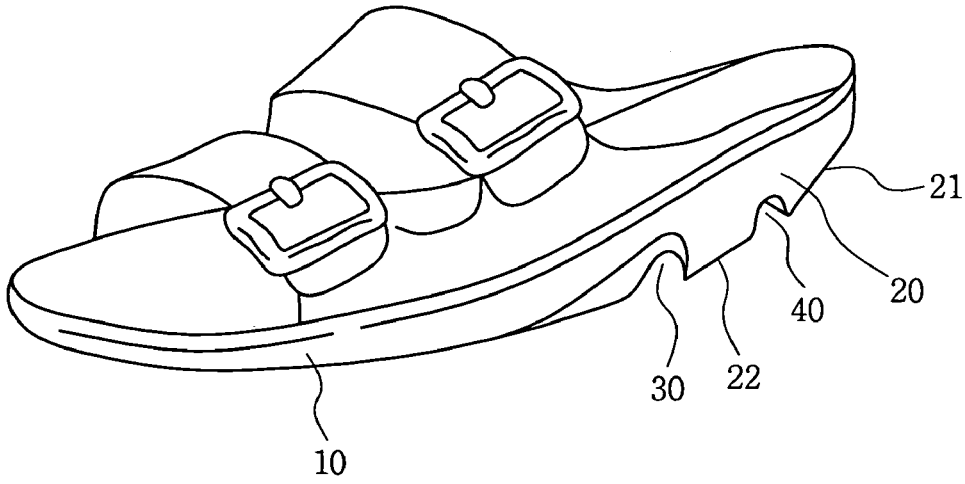

In addition, when the landing procedure is followed from the first cutout 21 of the rear portion to the second cutout 22 and the bottom side of the front portion 10 while standing still on the shoes with the shoe sole of the present invention, a load caused by the weight is shifted to the hatched portion of FIG. 18 to achieve contraction and relaxation of the Achilles tendon and promote blood circulation in the arrow direction.

FIGS. 19A to 19G show examples of shoes using the shoe sole of the present invention.

When walking on the shoes with the shoe sole of the present invention, the first and second cutouts 21 and 22 are in close contact with the ground elastically, the pedestrian has his/her body tensed from bottom to top to keep a straight posture and maintain the vertebra straight for a good posture. Furthermore, the weight of the body can be properly dispersed during walking or exercise without a load on the joints or the waist, so a straight posture can prevent diseases such as arthritis, back pain, muscle pain, or the like.

In particular, walking on the healthful shoes according to the present invention increases amounts of oxygen inhalation, free fatty acid, and glycerol in the body to promote activation of the metabolism.

As described above, the present invention provides a shoe sole for triple-time stepping with an improved structure that the shoe sole is divided into front and rear portions 10 and 20, the rear portion 20 being inclined in two steps to have first and second cutouts 21 and 22, with a boundary portion between the front and rear portions 10 and 20 and a boundary portion between the first and second cutouts 21 and 22 being recessed upward in a predetermined depth. The improved shoe sole of the present invention remarkably mitigate a fatigue on walking, has a massage effect produced from a proper stimulation of the flow of energy to prevent flat-foot walks and promote metabolism and blood circulation, and disperses the impact force caused by the weight to prevent diseases such as arthritis, back pain, muscle pain, or the like.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

The invention claimed is:

1. A shoe sole for triple-time stepping, comprising:

a front portion having a front end gently inclined upward, and a bottom portion in even contact with the ground;

a rear portion having a second cutout inclined upward at an angle of about 5° to 17° from a rear end of the front portion, and a first cutout inclined upward at an angle of about 5° to 25° from a rear end of the second cutout;

a first recess formed upward in a predetermined depth on a boundary portion between the front portion and the second cutout; and a second recess formed upward in a predetermined depth on a boundary portion between the second cutout and the first cutout.

2. The shoe sole for triple-time stepping as claimed in claim 1, wherein the front and rear portions have a proportion of 55–70%: 45–30% with respect to a front end of the first recess.

3. The shoe sole for triple-time stepping as claimed in claim 2, wherein the proportion of the first cutout is 13 to 19% of the rear portion, the proportion of the second cutout being 18 to 24% of the rear portion.

4. The shoe sole for triple-time stepping as claimed in claim 1, wherein the boundary portion between the front and rear portions is recessed inward to have a gap 1 of about 3 to 5 mm between upper and lower ends on both end sides of the first recess.

5. The shoe sole for triple-time stepping as claimed in claim 1, wherein for a shoe size of more than 275 mm, a vertical height A on a front end of the first recess starting the rear portion is about 31 mm, the height B from the ground to a rear end of the first cutout of the rear portion being about 27 mm, the height C from a lower end of the first cutout to the uppermost end on a rear end of the rear portion being about 32 mm.

6. The shoe sole for triple-time stepping as claimed in claim 1, wherein for a shoe size of 260 to 270 mm, a vertical height A on a front end of the first recess starting the rear portion is about 30 mm, the height B from the ground to a rear end of the first cutout of the rear portion being about 26 mm, the height C from a lower end of the first cutout to the uppermost end on a rear end of the rear portion being about 32 mm.

7. The shoe sole for triple-time stepping as claimed in claim 1, wherein for a shoe size of 245 to 255 mm, a vertical height A on a front end of the first recess starting the rear portion is about 29 mm, the height B from the ground to a rear end of the first cutout of the rear portion being about 25 mm, the height C from a lower end of the first cutout to the uppermost end on a rear end of the rear portion being about 35 mm.

* * * * *